United States Patent [19]

Terlecki

[11] 4,240,685

[45] Dec. 23, 1980

[54] FILE LOCK AND INTERLOCK

[75] Inventor: Leo Terlecki, Youngstown, Ohio

[73] Assignee: GF Business Equipment, Inc., Youngstown, Ohio

[21] Appl. No.: 9,599

[22] Filed: Feb. 5, 1979

[51] Int. Cl.[3] ..... E05B 65/46; E05C 15/04

[52] U.S. Cl. ..... 312/217; 312/221

[58] Field of Search ..... 70/82-86, 70/107.5; 312/216-221; 292/47, 49, 197, 215

[56] References Cited

U.S. PATENT DOCUMENTS

| | | | |
|---|---|---|---|
| 3,776,007 | 12/1973 | Himsl | 312/219 |
| 3,883,200 | 5/1975 | Latham | 312/221 |
| 3,909,090 | 2/1975 | Breckner et al. | 312/217 |
| 3,936,108 | 2/1976 | Chitester | 312/217 |

*Primary Examiner*—Casmir A. Nunberg

*Attorney, Agent, or Firm*—Emory L. Groff, Jr.

[57] ABSTRACT

A file arrangement includes a cabinet housing, a plurality of vertically stacked file elements with an interlock assembly carried by one cabinet lateral wall precluding the opening of more than one element at a time as the first opened drawer vertically displaces a roller on the assembly to block any displacement of similar rollers adjacent the remaining file elements. A separate lock bar assembly adjacent the opposite cabinet lateral wall includes a plurality of lock dogs engageable with the front of the file elements and vertically shiftable upon actuation of a lock mechanism. Operation of the lock mechanism and its associated lock bar assembly also actuates a transfer rod joining both assemblies to simultaneously and equally displace the interlock assembly and a plurality of lock dogs thereon to lock both sides of all file elements within the cabinet.

7 Claims, 8 Drawing Figures

FILE LOCK AND INTERLOCK

This invention relates generally to file or storage devices and more particularly to an improved combined lock and interlock system providing both locking means for all storage elements within a cabinet as well as precluding the operation or withdrawal of more than one storage element at a time.

Interlock assemblies for cabinets housing a plurality of rectilinearly displaceable storage elements have been known for some time and a typical example of such a system will be found in U.S. Pat. No. 3,900,236 dated Aug. 19, 1975 and which is assigned to the assignee of the present invention. The instant invention provides a valuable improvement over the arrangement set forth in the reference patent, the latter of which provides a plurality of vertically displaceable lock bars supporting a rotary cam member and disposed adjacent the rear wall of the cabinet. In the present invention, the interlock system is relocated adjacent the front of the cabinet thus facilitating the initial manufacture and installation thereof and providing far greater accessibility should any subsequent maintenance by the user be required. Additionally, the specially configured rotary cam elements of the patented device are replaced by a simplified structure comprising cylindrical actuating rollers.

Combined with the present interlock assembly is an improved lock mechanism comprising a plurality of pivotal lock dogs located within both lateral walls of the cabinet so that upon actuation of a central lock mechanism, a pair of these lock dogs engage a pair of laterally spaced keepers associated with the front of each one of the storage elements of the cabinet. The advantage of providing positive locking means at the two lateral extremes of each of the storage elements will be readily appreciated. In most cabinets a single lock element is provided adjacent one lateral portion of each of the storage elements and often leads to a compromise in the security of the locked storage elements since a trespasser may insert a pry tool into the opposite lateral edge in an effort to force open the cabinet. The need for providing dual, laterally spaced locking means for each storage element is particularly desirable in the case of the currently popular lateral files wherein each storage element encompasses a substantial width in relation to its depth.

By the present invention, an improved file lock and interlock system is provided including an interlock assembly having a plurality of vertically aligned lift bars slidably mounted within the file cabinet for limited vertical dispacement adjacent one lateral wall thereof while a unitary lock bar assembly is disposed adjacent the interior of the opposite cabinet lateral wall. Both the interlock assembly and lock bar assembly are provided with a similar number of pivotially mounted lock dogs and actuation of a lock mechanism associated with the lock bar assembly, produces a vertical displacement of a unitary lock bar and its lock dogs concurrently with a similar vertical displacement of the entire interlock assembly associated with the opposite lateral wall of the cabinet. The foregoing described concurrent vertical displacement of the two assemblies is achieved by means of a unitary transfer rod pivotially mounted adjacent the forward portion of the cabinet floor plate.

Accordingly, one of the primary objects of the present invention is to provide an improved file lock and interlock system including a plurality of vertically aligned lift bars supported adjacent one lateral wall of a cabinet housing and each carrying an actuating roller engageable by activator means mounted on each storage element and wherein the first opened storage element pivotally displaces at least one of the lift bars and its actuator means to immobilize all of the remaining lift bars to prevent opening of any of the remaining storage elements.

An additional object of the present invention is to provide an improved file lock and interlock system including, adjacent one cabinet lateral wall, a lift bar associated with each one of a plurality of displaceable storage elements and including an activator roller associated with a pivotal lock dog and with a lock bar mounted adjacent the opposite cabinet lateral wall and vertically displaceable to concurrently vertically displace all of the lift bars and their attached locked dogs.

A further object of the present invention is to provide an improved file lock and interlock system including an interlock assembly mounted for vertical displacement adjacent one cabinet lateral wall and including a plurality of lock dogs together with a lock bar assembly adjacent the opposite cabinet lateral wall and likewise including a plurality of lock dogs and whereupon vertical displacement of the lock bar assembly concurrently elevates the lock dogs carried by the lock bar assembly and the lock dogs carried by the interlock assembly.

With these and other objects in view which will more readily appear as the nature of the invention is better understood the invention consists of the construction, combination and arrangement of parts hereinafter more fully described, illustrated and claimed.

A practical embodiment of the present invention is shown in the accompanying drawings in which.

Similar reference characters designate corresponding parts throughout the several figures of the drawings.

Figure 1:
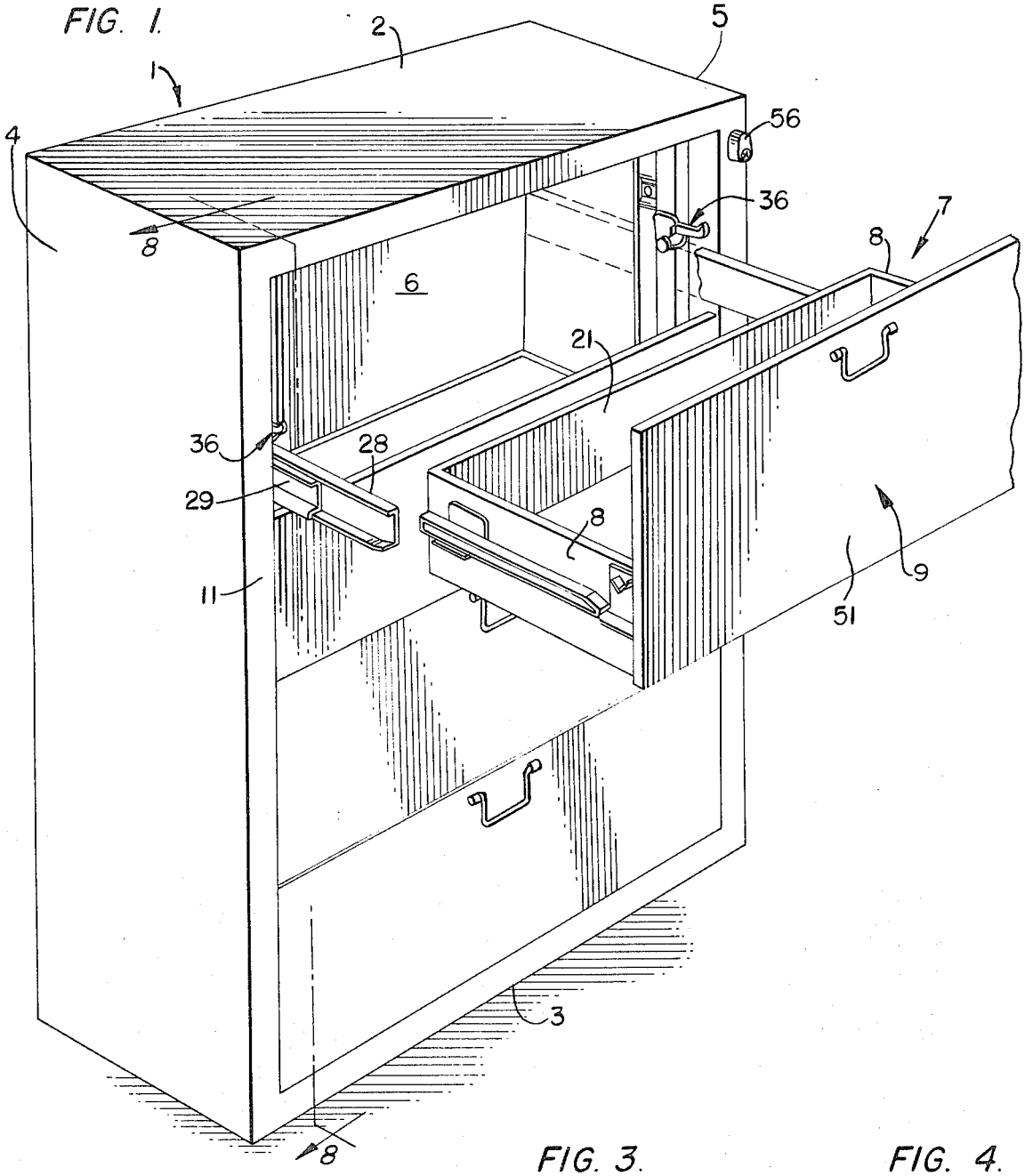
FIG. 1 is a perspective view of the present invention with one of the storage elements disposed in an exploded open relationship.

Referring now to the drawings, particularly FIG. 1, the present invention will be seen to relate to a filing device such as the cabinet 1, comprising a top wall 2 and a bottom wall 3 bounded by a pair of spaced apart lateral walls 4 and 5. An appropriate rear wall or panel 6 may be provided. The cabinet 1 is intended to house a plurality of vertically stacked storage or file elements such as the drawers 7, each including sides 8 joined to a drawer front 9.

The drawings illustrate the drawers 7 as comprising file elements having a width which is substantially greater than the depth thereof and reflects a cabinet assembly commonlly referred to as a lateral file yet it will be appreciated that the present invention will be applicable to any type of filing device comprising a plurality of rectilinearly displaceable file elements contained within a housing or cabinet. Thus, slidable shelves, drawers or storage bins of various dimensions may be combined with the cabinet 1.

Figure 2:
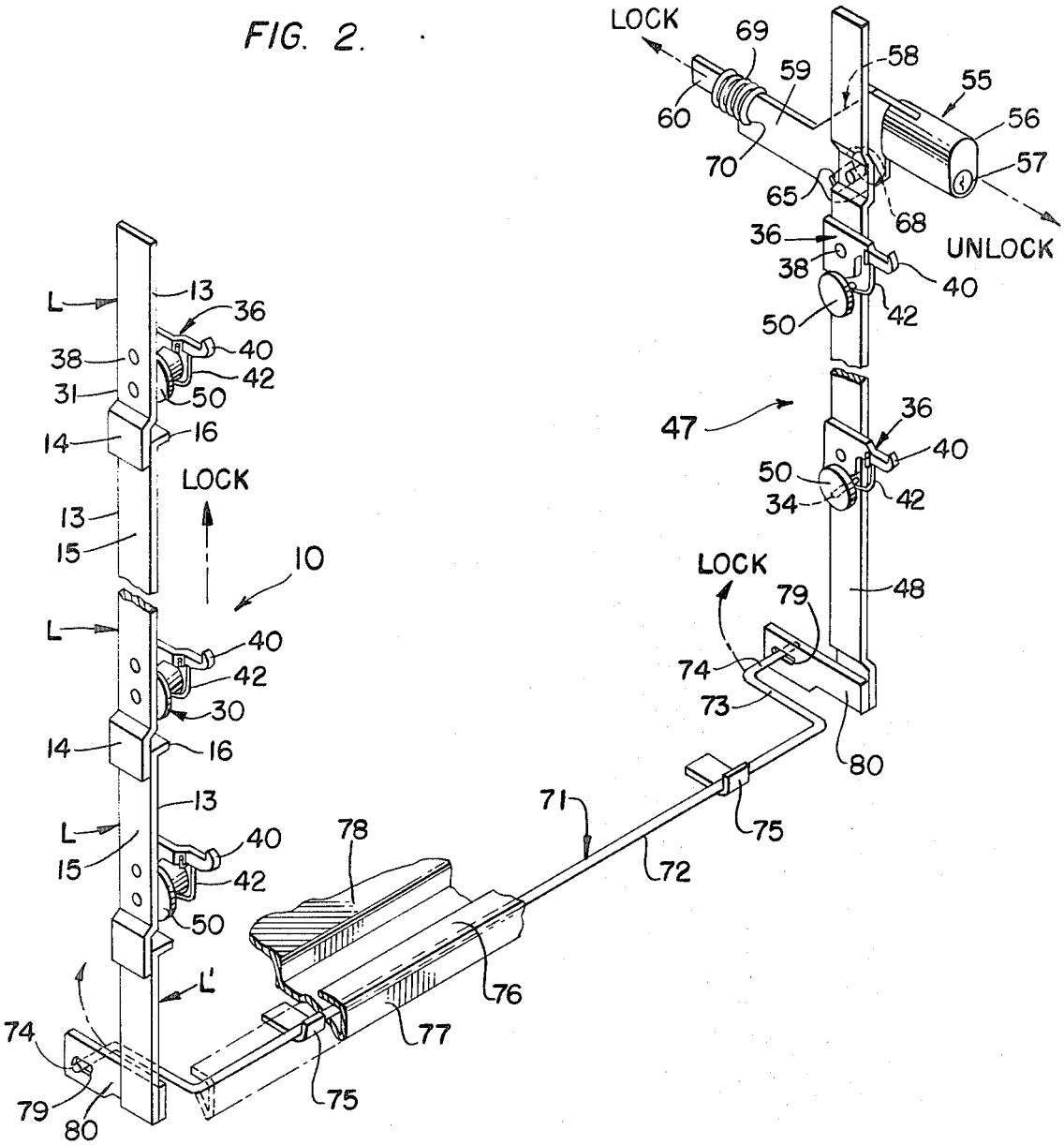
FIG. 2 is an enlarged perspective view illustrating the interlock assembly and lock bar assembly joined by a transfer rod.
Figure 8:
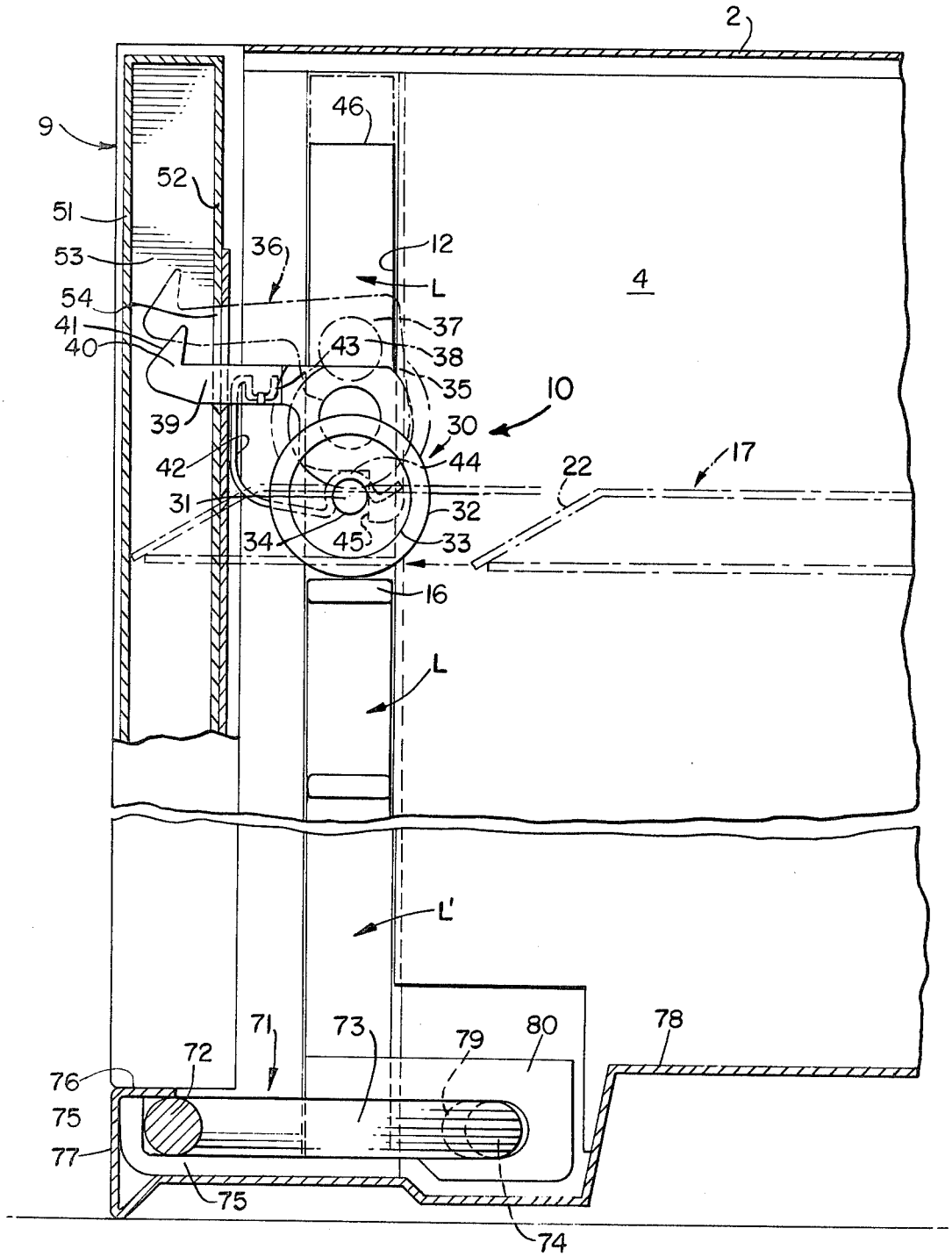
FIG. 8 is a vertical sectional view taken along the line 8—8 of FIG. 1.

As shown most clearly in FIGS. 1, 2 and 8, a file interlock assembly, generally designated 10, is mounted within the interior of the cabinet 1 adjacent the inner surface of one lateral wall 4 and juxtaposed the front 11 of the cabinet. The assembly 10 includes a plurality of vertically aligned, individual lift bars L all slidably disposed within and guided by a vertical interlock assembly channel 12 provided adjacent the interior of the lateral wall 4. A separate lift bar L is provided for each drawer of file element 7 and each one will be seen to include a main body 13 comprising the majority of the longitudinal extent thereof and which terminates at its lower end in an off-set tab 14 slidably engaging the outside surface 15 of the next lowest lift bar L. The juxtaposed top-most portion of each intermediate lift bar L is formed with an inturned flange 16 as shown most clearly in FIG. 2 of the drawings. For reasons which will be come apparent hereinafter, the uppermost lift bar L need not be provided with the top inturned flange 16 and additionally, a separate starter lift bar L' having an inturned flange 16 is positioned beneath the lift bar L intended to serve the lower-most drawer 7 of the cabinet 1.

Figure 3:
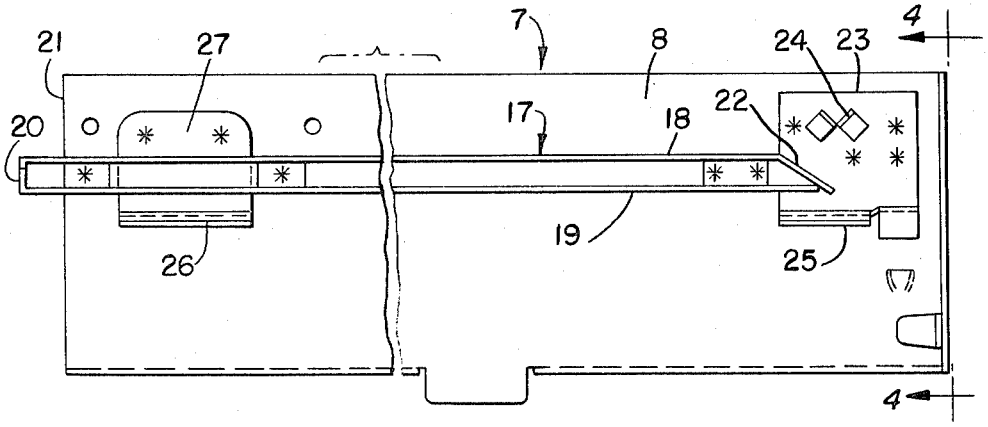
FIG. 3 is an enlarged side elevation of one side of a storage element.
Figure 4:
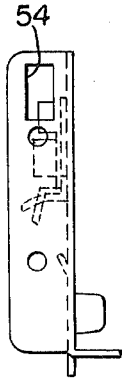
FIG. 4 is a front elevation taken along the line 4—4 of FIG. 3.

As previously mentioned, a separate lift bar L is provided within the interior of the cabinet adjacent one side 8 of each drawer 7 and this drawer side is provided with an interlock channel 17 shown most clearly in FIGS. 1 and 3 of the drawings. Each interlock channel is provided with a horizontal upper flange 18 and a parallel spaced-apart lower flange 19 having a rear 20 extending to a point adjacent the rear wall 21 of the drawer. As shown in FIG. 3, the upper flange 18 terminates forwardly at a point short of the forward terminus of the lower flange 19 and is joined to an interlock activator comprising an inclined ramp or cam 22 extending downwardly from the upper flange 18 to a point overlying and substantially in the same plane as the lower flange 19.

A forward mounting plate 23 attached to the drawer side 8 includes an interlock deactivator comprising a pair of ramps or cams 24 forming a V-configuration and disposed at a point in a plane above the channel upper flange 18 and forwardly thereof. Each forward mounting plate 23 additionally includes, along its lower edge, a suspension channel hanger 25 disposed in the same horizontal plane as a similar supsension channel hanger 26 forming a part of the rear mounting plate 27 attached to the drawer side 8. Similar suspension channel hangers 25–26 are attached to the opposite drawer side (not shown) and serve as means for supporting each drawer 7 for rectilinear displacement in a fixed horizontal plane relative the interior of the cabinet 1. This attachment is provided by means of suitable drawer suspension channels 28 slidably cooperating with appropriate cabinet-attached suspension channels (not shown) and may further include an intermediate drawer suspension channel 29 as shown in FIG. 1 of the drawings, which suspension arrangement is well known in the art.

With the foregoing structure in mind, the specific mechanism for providing the file interlock as well as the locking of the drawers 7 within the cabinet by means of structure located adjacent the lateral wall 4 may now be described. With the exception of the bottom-most starter lift bar L', each of the lift bars L are provided with an interlock actuating roller 30 adjacent the offset tab 14 thereof. Each actuating roller 30 comprises a cylindrical member pivotally attached as at 31 and including an enlarged diameter flange 32 adjacent the lift bar main body 13 and an integral reduced diameter hub 33 as shown most clearly in FIGS. 2 and 8 of the drawings. A smaller diameter stem 34 extends rearwardly from each actuating roller 30 and supports the roller with its flange 32 spaced from the lift bar main body 13 a small distance. Disposed within this space is the depending arm 35 of a lock dog 36 having a base 37 pivoted to the lift bar as at 38. Each lift bar includes a forwardly extending arm 39 which projects well ahead of the outer periphery of the actuating roller 30 terminating in an upwardly projecting hook or catch 40 having an upwardly and rearwardly inclined cam surface 41.

Each lock dog 36 is maintained in a normal at-rest position by means of a spring 42 having a first end 43 engageable with the dog arm 39 at a point ahead of the roller pivot 31 and a second end 44 engageable with the roller stem 34, as will be seen from a review of FIG. 8 of the drawings.

The spring 42 preferably comprises a pre-stressed spring wire and is intended to normally urge the lock dog arm 39 and its hook or catch 40 in an elevated position with the shoulder or stop 45 formed as a forwardly facing portion of the depending arm 35, in abutment with the roller stem 34. When the interlock assembly 10 is not actuated that is, when all of the drawers 7 are fully enclosed within the cabinet 1, it will be understood that each of the lift bars L are disposed in their lowestmost position. This means that since the lift bars L are freely slidably disposed within the guide channel 12 inside the cabinet lateral wall 4, the lower part of each lift bar L will be resting upon the inturned flange 16 of the next lowest lift bar and the actuating rollers 30 will be disposed as shown in the full line position of FIG. 8 of the drawings.

FIG. 8 also illustrates the alternate positions of the drawer interlock channel 17 and it will be understood that when the drawers are fully closed this channel will appear as illustrated in the right hand most position, that is, well behind its associated actuating roller 30. The width or lateral extent of the flanges 18 and 19 of the drawer channel 17 will be understood to be disposed at all times within a horizontal plane aligned with the width of the hub 33 of the actuating roller so that upon opening of a first drawer 7 in the cabinet 1 the interlock channel will progressively move to the left hand-most illustrated position of FIG. 8, during which time the interlock activator or ramp 22 of the channel 17 initially passes beneath the roller hub 33 and thereafter forces this roller upwardly as the drawer is opened, after which the bottom periphery of the roller hub 33 will roll over the upper surface of the interlock channel flange 18 as shown in the broken line illustration of FIG. 8. When in this opened position the top edge 46 of the uppermost lift bar L will be elevated to a point juxtaposed the cabinet top wall 2 and the blocking means or lower flange 19 will be seen to be disposed just above the next lowest inturned flange 16. From the foregoing it will be appreciated that the first drawer to be opened causes elevation of the associated adjacent lift bar and at the same time, blocks any possible elevation of all lower lift bars. This action precludes any additional vertical displacement of any of the lift bars of the interlock assembly 10 since the clearance between the top edge 46 and the cabinet interior is selected to allow for the vertical displacement associated with the opening of only one drawer such that if one should attempt to open a second lower drawer the associated interlock channel ramp 22 will strike the juxtaposed actuating roller hub 33 and further drawer movement will be precluded since the actuating roller 30 will not yield to any vertical displacement. In this manner all lower drawers will be blocked while movement of the upper drawers is halted when the activator ramp 22 strikes an adjacent elevated inturned flange 16.

Upon closing of an opened drawer the periphery of the roller hub 33 travels across the interlock channel upper flange 18 until reaching the downwardly inclined ramp 22 at which point gravity normally urges the previously elevated roller and its lift bar downwardly to the at-rest position of FIG. 2 of the drawings. To preclude the possibility of hanging up of the previously elevated lift bar and its actuating roller 30 during the closing of any drawer, the ramps 24 of the deactivator engages the upper periphery of the roller hub 33 as the bottom periphery of the hub reaches the depending channel ramp 22 and continued closing of the drawer positively forces the actuating roller downwardly.

From the foregoing it will be appreciated that positive, simplified means are provided to insure a drawer interlock system for a file cabinet 1. As previously mentioned, the interlock assembly 10 additionally includes lock means cooperating with similar lock means adjacent the opposite cabinet lateral wall to firmly secure and retain all of the drawers 7 of the cabinet in a locked condition when fully disposed within the cabinet. In the case of the interlock assembly 10 this lock means comprises the individual lock dogs 36 pivotally carried by each of the lift bars L. A single lock dog 36 is provided for each of the drawers 7 of the cabinet 1 adjacent the left hand edge of each drawer front. Similar locking means are provided adjacent the cabinet lateral wall 5 for cooperation with the right hand edge of each drawer front 9 and comprises a plurality of lock dogs 36 carried by a lock bar assembly, generally designated 47.

Figure 5:
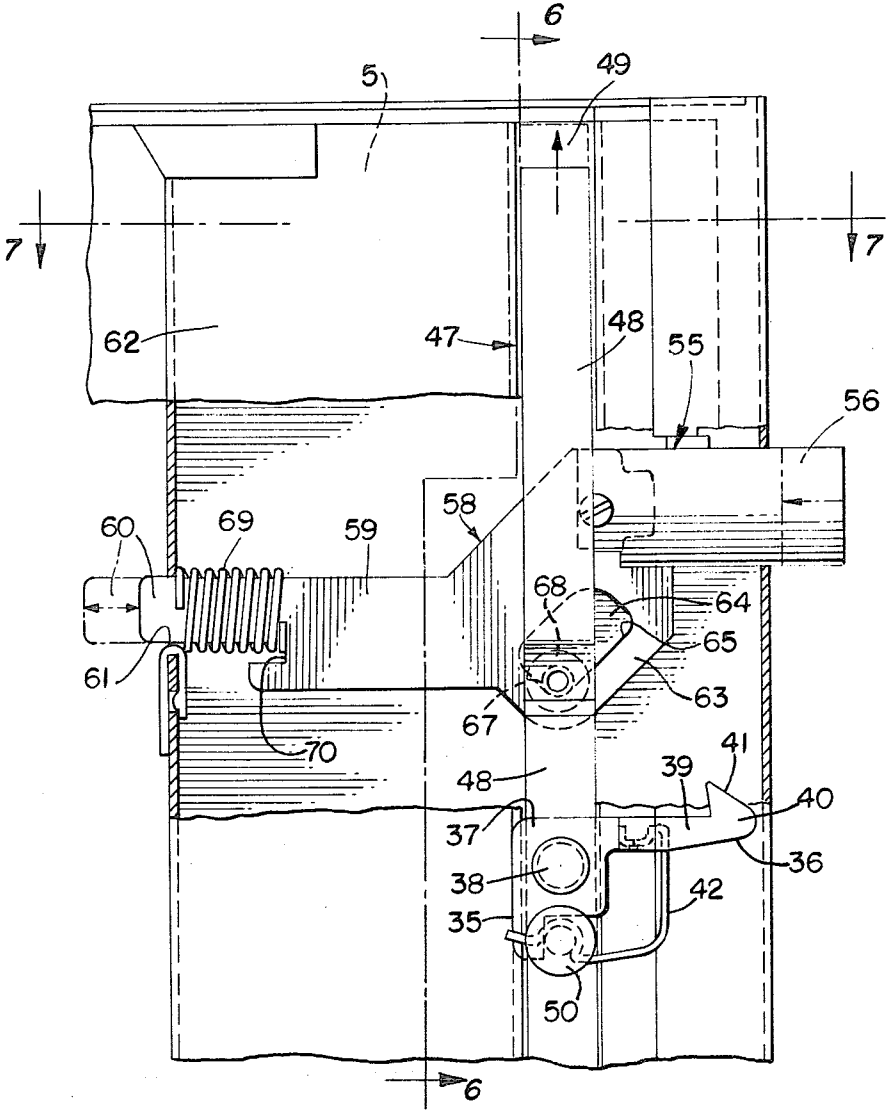
FIG. 5 is a fragmentary side elevation illustrating the lock mechanism and top portion of the lock bar assembly.

As shown most clearly in FIGS. 2 and 5 of the drawings, the lock bar assembly 47 comprises a unitary vertically extending lock bar guide channel 49 formed adjacent the interior of the cabinet lateral wall 5. As in the case of the lock dogs carried by the individual lift bars L, the lock dogs associated with the lock bar assembly 47 each include a base 37 pivotally attached to the lock bar 48 as at 38 and having a forwardly extending arm 39 terminating in an upwardly projecting catch 40 provided with the upwardly and rearwardly inclined cam surface 41.

A stem 34 mounted upon the lock bar 48 beneath each lock dog 36 includes an outer flange 50 and functions in a manner similar to the stem 34 of the lock dogs carried by the lift bars of the interlock assembly 10. As shown most clearly in FIG. 5 of the drawings, the spring 42 is provided with a first end 43 engaging the lock dog arms 39 and a second end 42 engaging the stems 34 so that when in the normal position the lock dogs are urged to locate the hook catch 40 in an uppermost position with the shoulder 45 of the lock dog depending arm 35 engaging the stem 34 carried by the lock bar 48. Thus, in the case of both the interlock assembly 10 and lock bar assembly 47, the stems 34 serve as limit means restricting the upward motion of the lock dog hooks 40.

Locking of all of the drawers 7 within the cabinet 1 is accomplished by means of the two laterally spaced apart lock dogs 36 associated with each drawer 7 and respectively mounted on the adjacent lift bar L and lock bar 48. As will be seen in FIG. 8 of the drawings, the drawer front 9 preferably includes an outer panel 51 spaced forwardly of an inner panel 52 to define an interior 53. The inner panel 52 includes an opening 54 serving as a lock keeper and which is of a vertical extent no less than the overall vertical height of the lock dog arm 39 and catch 40 so that when the lock dogs 36 are in the normal at-rest position as shown in full lines in FIG. 8, there is no interfering action when the drawer front is moved toward or away from the lock dog. On the other hand, upon elevation of the respective lift bar L it will be understood that the attached pivoted lock dog 36 will be moved to the broken line position of FIG. 8 until the top surface of the forwardly extending arm 39 abuts the uppermost limit of the keeper opening 54 and the hook catch 40 is disposed within the drawer front interior 53 in a plane above the opening 54 thereby precluding withdrawal of the drawer 7 from the cabinet.

Figure 7:
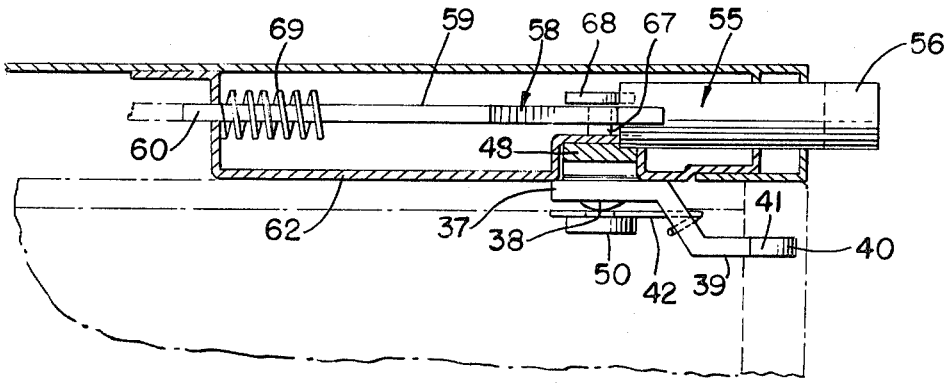
FIG. 7 is a horizontal sectional view taken along the line 7—7 of FIG. 5.
Figure 6:
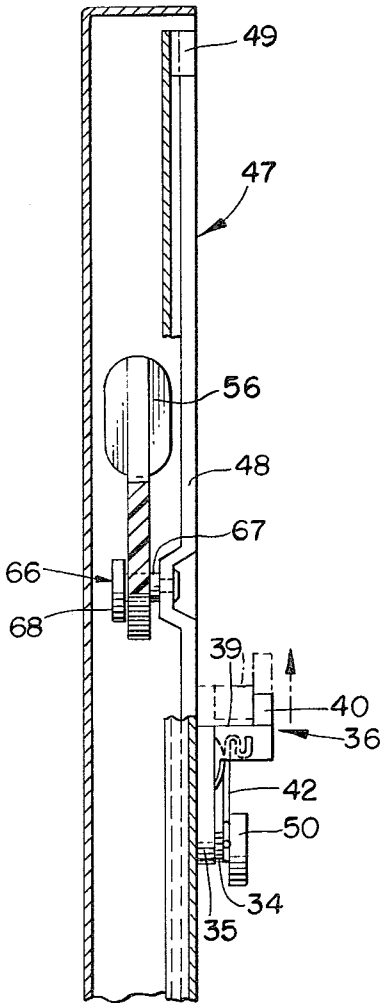
FIG. 6 is a vertical transverse sectional view taken along the line 6—6 of FIG. 5.

The mechanism for producing the above described elevation of all of the lock dogs carried by both the interlock assembly 10 and lock bar 47 may now be described. Mounted for rectilinear displacement adjacent the upper portion of the lock bar 48 is a lock mechanism, generally designated 55 and which includes a lock plunger 56 of any suitable well known construction and preferably including a key set 57. In its normal at-rest or open and unlocked position, the lock mechanism 55 appears as shown in FIGS. 2, 5 and 7 of the drawings. This mechanism includes a lock bar actuating plate 58 affixed to the lock plunger 56 and having a longitudinal arm 59 terminating in a tail 60 which may be suitably supported for rectilinear motion such as by passage through a slot 61 formed in a supporting channel 62 adjacent the interior of the cabinet lateral wall 5. The longitudinal arm 59 will be seen to be disposed for rectilinear motion in a horizontal plane lower than that of the lock plunger 56 and is joined thereto by a medial section 63 having an aperture 64 providing a cam surface or ramp 65 inclined upwardly and forwardly from said arm 59 to the lock plunger 56. Constantly engaging the ramp 65 is a lift pin 66 fixed to the upper portion of the lock bar 48 and including a hub 67 riding on the ramp 65 and an enlarged distal head 68 serving to retain the hub 67 juxtaposed the ramp 65. A lock bar spring 69 of the compression type surrounds the rear portion of the arm 59 and constantly bears at one end upon the supporting channel 62 adjacent the opening 61 and at the other end upon a shoulder 70 on the arm 59. In this manner, the lock mechanism will normally be urged toward the front 11 of the cabinet to urge the lift pin 66 to its lowest position in the aperture 64 whereby the lock bar assembly will be disposed in its lowest most, unlocked position such that the hook catches 40 of the associated lock dogs 36 are all disposed in horizontal planes allowing of free passage into and out of the openings 54 formed along the right hand edge of each of the drawer fronts 9.

Upon rectilinear displacement of the lock plunger 56 from the full line to the broken line position of FIG. 5, the actuating plate 58 is similarly displaced rearwardly as the medial section 63 and its captive lock bar lift pin 66 elevated due to the rearward movement of the cam surface 65 which constantly engages the lift pin. This movement vertically displaces all of the lock dogs 36 carried by the lock bar assembly 47 into an elevated plane which positions the lock dog catches 40 at a point above the keeper opening 54 of the respective drawers thereby preventing the opening of any of the drawers 7 of the cabinet 1. Should the lock mechanism 55 be actuated by depressing the plunger 56 and its attached lock bar actuating plate 58 at any time when one of the drawers is still in the retracted or opened position, it will be understood that upon closing of this drawer 7 the rear of the drawer front 9 will strike the inclined surface 41 of the elevated lock dog hook 40 and deflect the same downwardly against the force of the spring 42 until the drawer is substantially fully closed at which time the spring returns the catch 40 to its elevated locking position with the lock dog shoulder 45 abuting the stem 34.

The above action occurs simultaneously between the lock dogs and keepers located adjacent both side edges of the closed drawer to positively secure the drawer within the cabinet. To achieve this simultaneous operation, all of the lock dogs 36 associated with the lift bars L of the interlock assembly 10 on the opposite side of the cabinet 1 are similarly elevated into the locking position by means of a transfer rod, generally designated 71, pivotally mounted in the lower, forward part of the cabinet adjacent the intersection of the cabinet bottom wall 3 and cabinet front 11.

The transfer rod 71 is constructed to provide equal and concurrent vertical displacement of the entire interlock assembly 10 and the lock bar assembly 47 and includes a cross member 72, preferably of bar or rod stock, extending substantially the width of the cabinet 1 and terminating at both ends in an arm 73 angularly disposed with respect to the cross member 72. Each arm 73 in turn terminates with an offset bar or crank 74 disposed substantially parallel to the cross member 72. When in the at-rest or unlocked position as shown in FIG. 2 of the drawings, the cranks 74 and cross member 72 are preferably disposed in a common horizontal plane, thus providing the lowest profile for mounting of the transfer rod 71 adjacent the bottom wall 3 of the cabinet. This cross member 72 is constrained to preclude unwanted radial displacement while allowing of free rotary motion thereof such as by the provision of a plurality of pivot plates 75 cooperating with the top wall 76 and front 77 of the cabinet bottom plate 78.

The distal portions of each of the cranks 74—74 are slidably disposed within a horizontal slot 79 formed adjacent the rear end of a lift arm 80 having its forward end respectfully suitably affixed to the bottom of the interlock assembly 10 and lock bar assembly 47 as shown most clearly in FIG. 2 of the drawings. With the foregoing structure in mind and with additional reference to the construction illustrated in FIG. 8, it will be understood that the vertical displacement of the lock bar assembly 47 produces a corresponding vertical movement of the lift arm 80 attached thereto together with a corresponding and concurrent displacement of the lift arm 80 attached to the interlock assembly 10 so that when the lock mechanism 55 is depressed, all of the lock dogs 36 carried by both the lock bar assembly 47 and interlock assembly 10 are vertically displaced in a concurrent and equal simultaneous manner.

I claim:

1. A file cabinet having a plurality of vertically stacked storage elements provided with interlock means for preventing the opening of more than one said element at a time, said interlock means including an interlock assembly having a plurality of vertically aligned lift bars in said cabinet for limited vertical displacement therein, guide means in said cabinet containing said lift bars, actuating means carried by each said lift bar each including rotatable lesser and greater diameter portions normally disposed immediately adjacent the next lower one of said lift bars, means mounting each said storage element within said cabinet for substantially horizontal rectilinear movement therein, activator means horizontally movable concurrently with each said storage element to engage one said actuating means to vertically displace its respective lift bar and any other lift bars thereabove, an inturned flange on each said lift bar beneath each said actuating means of the next higher lift bar, blocking means adjacent said activator means overlying said inturned flange of the next lowest lift bar when one said storage element is opened to preclude elevation of any lift bars below and thus opening of any other storage elements below, while said storage elements above said opened storage element are precluded from opening as their respective activator means is blocked from rectilinear displacement by the elevated inturned flanges of said lift bars above said opened storage element, a lock dog attached to each said lift bar and having a distal catch, said storage elements having a front provided with keeper means horizontally aligned with said lock dog catches, and means selectively operable to simultaneously elevate and lower all of said lift bars and attached lock dogs to respectively engage and disengage all said catches relative said keeper means.

2. A file cabinet including first and second lateral walls having a plurality of vertically stacked storage elements provided with interlock means for preventing the opening of more than one said element at a time, said interlock means including an interlock assembly having a plurality of vertically aligned lift bars in said cabinet for limited vertical displacement therein, said interlock assembly mounted only within said first lateral wall adjacent the front thereof, guide means in said cabinet containing said lift bars, actuating means carried by each said lift bar each including rotatable lesser and greater diameter portions normally disposed immediately adjacent the next lower one of said lift bars, means mounting each said storage element within said cabinet for substantially horizontal rectilinear movement therein, activator means horizontally movable concurrently with each said storage element to engage one said actuating means to vertically displace its respective lift bar and any other lift bars thereabove, said activator means including an upper flange projecting laterally from one side of each said storage element adjacent said interlock assembly, said upper flange extending substantially the depth of said storage element side, a ramp projecting downwardly from the forward edge of said upper flange, an inturned flange on each said lift bar beneath each said actuating means of the next higher lift bar, blocking means adjacent said activator means overlying said inturned flange of the next lowest lift bar when one said storage element is opened to preclude elevation of any lift bars below and thus opening of any other storage elements below, while said storage elements above said opened storage element are precluded from opening as their respective activator means is blocked from rectilinear displacement by the elevated inturned flanges of said lift bars above said opened storage element, and separate fixed de-activator means projecting from each said storage element side at an elevation spaced above said activator ramp forwardly of said upper flange whereby, said de-activator means engages said actuating means upon closing of said storage element to insure downward displacement of said actuating means and attached lift bar.

3. A file cabinet having a pair of lateral walls housing a plurality of vertically stacked, rectilinearly displaceable storage elements therein, each said storage element having a front provided with keeper means adjacent both side edges thereof, a vertically displaceable lock bar adjacent the interior of one said cabinet lateral wall, a plurality of vertically displaceable lift bars adjacent the interior of the other one of said cabinet lateral walls, a plurality of lock dogs carried by both said lock bar and said lift bars, said lock dogs having a forwardly projecting catch horizontally aligned for free movement past said keeper means when said lock bar and lift bars are disposed in a first vertical position, a lock mechanism connected to said lock bar and operable to shift said lock bar to a second vertical position and engage said lock bar dog catches with respective said keeper means adjacent one side edge of all said storage element fronts, a transfer rod disposed adjacent the bottom of said cabinet and having opposite ends respectively connected to the lower portion of said plurality of lift bars and said lock bar whereby, operation of said lock mechanism concurrently vertically shifts said lift bars and attached lock dogs relative said keeper means adjacent the other side edge of all said storage element fronts.

4. A file cabinet according to claim 1 wherein, said lock dog catch each includes an upwardly and rearwardly inclined outermost cam surface, and a spring constantly urges each said lock dog catch into an uppermost position.

5. A file cabinet according to claim 1 including, a lock bar assembly within said cabinet adjacent said lateral wall opposite that associated with said interlock assembly, said lock bar assembly having a lock bar provided with a plurality of lock dogs having distal catches, said storage element fronts provided with keeper means horizontally aligned with said lock bar lock dog catches, and said selectively operable means includes a lock mechanism to elevate or lower said lock bar and a transfer rod joining said interlock and lock bar assemblies.

6. A file cabinet according to claim 3 wherein, said lock bar includes a lift pin attached thereto, said lock mechanism provided with a horizontally displaceable actuating arm, said arm having an inclined cam surface engageable with said lift pin whereby, horizontal movement of said arm is transmitted as vertical movement of said lock bar.

7. A file cabinet according to claim 3 including, a separate offset lift arm affixed to the lowest one of said plurality of lift bars and to said lock bar, said transfer rod having a central pivotal cross member provided with angular arms and each said arm terminating in a crank portion respectively engaging said offset lift arms.

* * * * *